US008584481B2

(12) United States Patent
Ariga

(10) Patent No.: US 8,584,481 B2
(45) Date of Patent: Nov. 19, 2013

(54) INTEGRATED AIR CONDITIONER

(75) Inventor: Tohru Ariga, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 1049 days.

(21) Appl. No.: 12/508,315

(22) Filed: Jul. 23, 2009

(65) Prior Publication Data

US 2010/0050682 A1 Mar. 4, 2010

(30) Foreign Application Priority Data

Aug. 28, 2008 (JP) ..... 2008-219090

(51) Int. Cl.

| | |
|---|---|
| ***F25D 21/14*** | (2006.01) |
| ***F25D 21/00*** | (2006.01) |
| ***F25D 17/04*** | (2006.01) |
| ***F25B 21/02*** | (2006.01) |
| ***F24F 3/14*** | (2006.01) |

(52) U.S. Cl.

USPC ..... 62/291; 62/3.4; 62/150; 62/186; 62/176.1; 62/176.6; 62/279; 62/280; 62/90; 62/91; 62/92; 62/139; 62/161; 236/44 C

(58) Field of Classification Search

USPC ..... 62/3.4, 291, 150, 186, 176.1, 176.6, 62/279, 280, 90, 91, 92, 139, 161; 236/44 C

See application file for complete search history.

(56) References Cited

U.S. PATENT DOCUMENTS

| | | | | |
|---|---|---|---|---|
| 7,752,863 | B2 * | 7/2010 | Kim et al. | 62/291 |
| 2004/0194490 | A1 * | 10/2004 | Lee et al. | 62/271 |
| 2006/0242973 | A1 * | 11/2006 | Manettas et al. | 62/151 |

FOREIGN PATENT DOCUMENTS

| | | | |
|---|---|---|---|
| JP | 05-042933 | * | 6/1993 |
| JP | 5-42933 | U | 6/1993 |
| JP | 5-203188 | A | 8/1993 |
| JP | 2006234251 | * | 7/2006 |
| JP | 2006-234251 | A | 9/2006 |
| JP | 2007-155198 | A | 6/2007 |

* cited by examiner

*Primary Examiner* — Frantz F. Jules
*Assistant Examiner* — Erik Mendoza-Wilkenfel
(74) *Attorney, Agent, or Firm* — Birch, Stewart, Kolasch & Birch, LLP

(57) ABSTRACT

An integrated air conditioner that controls the operation of a water feed device according to the mode of use. The air conditioner includes a control section that determines whether or not exhaust heat from a condenser 3 is being released outdoors through an exhaust duct 7 according to whether or not an air intake duct 26 or an exhaust duct 7 is fitted, operates a water feed device 8 for leading drain wafer collected in the drain pan to the condenser 3 during both of a cooling operation and a dehumidifying operation if it determines that the heat to be released from the condenser 3 is being released outdoors, and operates the water feed device 8 during the cooling operation and stops the operation of the water feed device 8 during the dehumidifying operation if it determines that the exhaust heat from the condenser 3 is not being released outdoors.

6 Claims, 8 Drawing Sheets

INTEGRATED AIR CONDITIONER

BACKGROUND OF THE INVENTION

1. Field of the Invention

The present invention relates to an integrated air conditioner which has an evaporator and a condenser integrally housed in a cabinet, and which is installed, for example, in a room where an air conditioner having an outdoor unit cannot be installed.

2. Description of the Related Art

In general, an integrated air conditioner has, as described in Japanese Patent Laid-Open No. 2006-234251, a cooling chamber and a heat release chamber formed in a cabinet, an evaporator provided in the cooling chamber, and a condenser provided in the heat release chamber. Air drawn into the cooling chamber is blown out through a blowout port. Air drawn into the heat release chamber is expelled through an exhaust port. One end of an exhaust duct is connected to the exhaust port. The other end of the exhaust duct is attached to a window or the like, thus enabling exhaust air from the heat release chamber to be expelled outdoors.

The above-described integrated air conditioner is used, for example, in such a room that neither the outdoor installation of an outdoor unit nor the placement of an integrated air conditioner on a waist-level window is possible. The integrated air conditioner ordinarily has casters for facilitating movement between rooms.

A drain pan in which condensed water condensed on an evaporator surface is collected is provided in a lower section of the evaporator, and a water feed device for leading drain water collected in the drain pan to the condenser is provided. Drain water led to the condenser is evaporated from a condenser surface to be expelled outdoors through the exhaust duct.

The air conditioner having the above-described structure is capable of moving to any room to perform a dehumidifying operation after detaching the exhaust duct attached to a window or the like because it is easy to move. The air conditioner can also be used as a spot cooler after detaching the exhaust duct from a window or the like.

However, the interior of a room cannot be dehumidified by the dehumidifying operation of the air conditioner having the above-described structure in a state where the exhaust duct is not attached to a window, because humidified air is expelled through the exhaust port when the water feed device is operated.

On the other hand, the above-described air conditioner is capable of performing the dehumidifying operation or the cooling operation in a state where the exhaust duct is attached to a window or the like. In this case, even when the water feed device is operated during the dehumidifying operation or the cooling operation, water evaporated from the condenser is expelled outdoors through the exhaust duct.

It is, therefore, an object of the present invention to provide an integrated air conditioner of high convenience in which the operation of a water feed device is suitably controlled according to the mode of use of the air conditioner.

SUMMARY OF THE INVENTION

To achieve the above-described object, according to the present invention, there is provided an integrated air conditioner having a compressor, an evaporator, a condenser, a drain pan in which drain water produced by the evaporator is collected, and a water feed device which leads drain water collected in the drain pan to the condenser, the compressor, the evaporator and the condenser being housed in a cabinet, the integrated air conditioner including a control section for controlling the operation of the water feed device, an air intake port and an exhaust port for drawing in and expelling of air for cooling the condenser, the air intake port and the exhaust port being formed in the cabinet, and an air intake duct and an exhaust duct which can be respectively fitted to the air intake port and the exhaust port, wherein the control section determines whether or not exhaust heat from the condenser is being released outdoors through the exhaust duct according to whether or not the air intake duct or the exhaust duct is fitted, operates the water feed device during both of a cooling operation and a dehumidifying operation if the control section determines that the exhaust heat from the condenser is being released outdoors, and operates the water feed device during the cooling operation and stops the operation of the water feed device during the dehumidifying operation if the control section determines that the heat to be released from the condenser is not being released outdoors.

In the above-described arrangement, the operation of the water feed device is stopped and drain water is collected in the drain pan during the dehumidifying operation in a case where it is determined that exhaust heat from the condenser is not being released outdoors, and the water feed device is operated even during the dehumidifying operation in a case where it is determined that exhaust heat from the condenser is being released outdoors, thus enabling obtaining an integrated air conditioner of high convenience according to the mode of use of the air conditioner.

To enable the control section to determine, from the fitted/non-fitted state of the air intake duct or the exhaust duct, whether or not exhaust heat from the condenser is being released outdoors through the exhaust duct, an air intake duct fitting detection section which detects the completion of fitting of the air intake duct to the air intake port is provided. When a fitting detection signal from the air intake duct fitting detection section is input to the control section, the control section determines that exhaust heat from the condenser is being released outdoors through the exhaust duct. When the fitting detection signal from the air intake duct fitting detection section is not input to the control section, the control section determines that exhaust heat from the condenser is not being released outdoors through the exhaust duct.

That is, there are two systems: a single-duct system and a double-duct system as a system in which the exhaust duct is connected to the exhaust port of the integrated air conditioner. The single-duct system is a system using one exhaust duct for expelling air from the condenser to the outside of a room ordinarily through a window. Air in the room is therefore used as intake air.

The double-duct system is a system using two ducts: the air intake duct and the exhaust duct for drawing in/expelling air ordinarily through a window so that air outside a room is drawn in through the air intake duct, undergoes heat exchange in the condenser, and is thereafter expelled out of the room through the exhaust duct. If this system is used, cool air in a room is not released to the outside in theory, so that the heat exchange efficiency is improved.

According to the above, the air intake duct is fitted to the air intake port in the case of adopting the double-duct system. In this case, use of this system presupposes fitting the exhaust duct to the exhaust port and expelling exhaust from the heat release chamber to the outside. Therefore, detection of the completion of fitting of the air intake duct to the air intake port enables determination as to whether exhaust heat from the condenser is being released outdoors by the double-duct system.

The method of determining the completion of fitting of the exhaust duct to the exhaust port through detection of the completion of fitting of the air intake duct to the air intake port as described above is effective particularly in a case where the integrated air conditioner has the exhaust duct fitted to the exhaust port at all times.

Further, in addition to the above-described arrangement, temperature sensors for respectively measuring the temperature of the evaporator and the indoor temperature may be provided and the control section may perform such control as not to operate the water feed device if it determines that the difference between the temperatures detected with the two temperature sensors is larger than a predetermined value even when the fitting detection signal from the air intake duct fitting detection section is input.

That is, in the case where the double-duct system is adopted, the open-air temperature can be estimated from the difference between the indoor temperature and the temperature of the evaporator (the lower the open-air temperature, the lower the temperature of the evaporator), because the cooling capacity of the refrigerating cycle is constant. For example, in a situation where the cooling operation starting button is accidentally pressed in a cold time in winter or in a situation where there is a need to perform a dehumidifying operation in a cold time in winter, therefore, it is possible to estimate that the open-air temperature is about 0° C. when the difference between the temperatures detected with the two sensors is equal to or larger than the predetermined value.

Thus, the operation of the water feed device is not performed when the difference between the indoor temperature and the temperature of the evaporator is larger than the predetermined value, thereby avoiding a risk of the water feed device being damaged by being operated under such a condition that drain water is frozen. Thus, provision of an air conditioner of higher convenience is enabled.

In the air conditioner arranged as described above, the control section can selectively execute one of a ventilating operation mode in which only an exhaust fan which draws in air through the air intake port and expels the drawn air through the exhaust port is operated in a state where the operation of the compressor is stopped and an air blowing operation mode in which only an indoor fan is operated as well as the cooling operation mode and the dehumidifying operation mode, and the control section restricts the execution of the ventilating operation mode and makes executable one of the cooling operation mode, the dehumidifying operation mode and the air blowing operation mode when the fitting detection signal from the air intake duct fitting detection section is being input.

That is, when the double-duct system is adopted, outside air is taken in the cabinet to cool the condenser and, therefore, ventilation by expelling indoor air to the outside is not performed even if the ventilating operation mode in which only the exhaust fan is operated is executed while the operation of the compressor is stopped as in the case of adopting the single-duct system. With the above-described arrangement, therefore, the execution of the ventilating operation mode is restricted to avoid wasteful execution of the operation mode when the double-duct system is adopted, thus enabling obtaining an air conditioner of high convenience.

Also, to enable the control section to determine, from the fitted/non-fitted state of the air intake duct or the exhaust duct, whether or not exhaust heat from the condenser is being released outdoors through the exhaust duct, an exhaust duct fitting detection section which detects the completion of fitting of the exhaust duct to the exhaust port is provided. When a fitting detection signal from the exhaust duct fitting detection section is input to the control section, the control section determines that exhaust heat from the condenser is being released outdoors through the exhaust duct. When the fitting detection signal from the exhaust duct fitting detection section is not input to the control section, the control section determines that exhaust heat from the condenser is not being released outdoors through the exhaust duct.

That is, in a certain form of a product, a method of directly detecting the completion of fitting of the exhaust duct to the exhaust port, for example, in a case where the exhaust duct is not originally fitted to the exhaust port of the integrated air conditioner, and where the exhaust duct is fitted to the exhaust port when heat to be released from the condenser is released outdoors is adopted to enable detection as to whether the single-duct system or the double-duct system is adopted.

The air intake duct fitting detection section may be provided together with the exhaust duct fitting detection section. In such a case, the control section first determines whether or not the double-duct system is adopted from the existence/nonexistence of the input of the fitting detection signal from the air intake duct fitting detection section. If the control section determines that the double-duct system is not adopted, it checks whether or not the fitting detection signal from the exhaust duct fitting detection section is input. The control section determines that the single-duct system is adopted if this signal is input, and determines that heat to be released from the condenser is not being released outdoors through the exhaust duct if this signal is not input. Discrimination of the single-duct system and the double-duct system is enabled in this way.

When the control section determines that the single-duct system is adopted, it does not perform control of the water feed device according to the temperature difference between the temperature of the evaporator and the indoor temperature or restriction on the execution of the ventilating operation mode, thus enabling obtaining an air conditioner of higher convenience.

According to the present invention, as described above, determination as to whether or not exhaust heat from the condenser is being released outdoors through the exhaust duct is made from the fitted/non-fitted state of the air intake duct or the exhaust duct. If it is determined that exhaust heat from the condenser is being released outdoors, the water feed device is operated during both of the cooling operation and the dehumidifying operation. If it is determined that exhaust heat to be released from the condenser is not being released outdoors, the water feed device is operated during the cooling operation and the operation of the water feed device is stopped during the dehumidifying operation, thus enabling obtaining an integrated air conditioner of high convenience according to the mode of use of the air conditioner.

DETAILED DESCRIPTION OF THE PREFERRED EMBODIMENTS

<First Embodiment>

Figure 1:
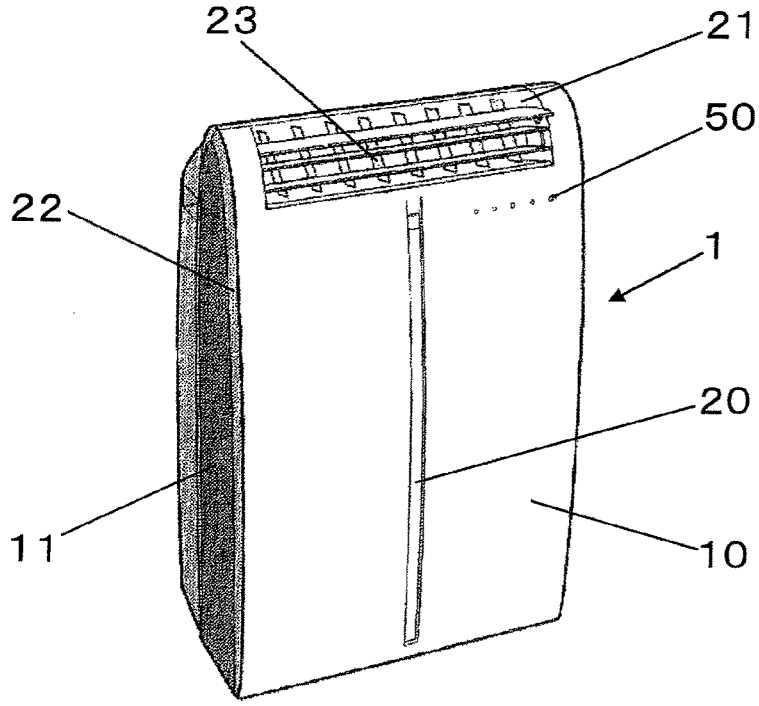
FIG. 1 is a perspective view of an air conditioner according to a first embodiment of the present invention.

A first embodiment of the present invention will be described with reference to the drawings. An integrated air conditioner according to the present invention has, as shown in FIGS. 1 to 4, a compressor 2, a condenser 3, an evaporator 4 and a restriction mechanism (not shown) housed in a cabinet 1. A refrigerating cycle is formed by these components. The air conditioner performs a cooling operation for cooling the interior of a room by producing cool wind. Accordingly, the air conditioner has a blow fan 5 on the evaporator 4, an exhaust fan 6 on the condenser 3, a drain pan 41 in which drain water produced by cooling operation is collected, and a splasher 8 provided as a water feed device for leading water collected in the drain pan 41 to the condenser 3.

Figure 2:
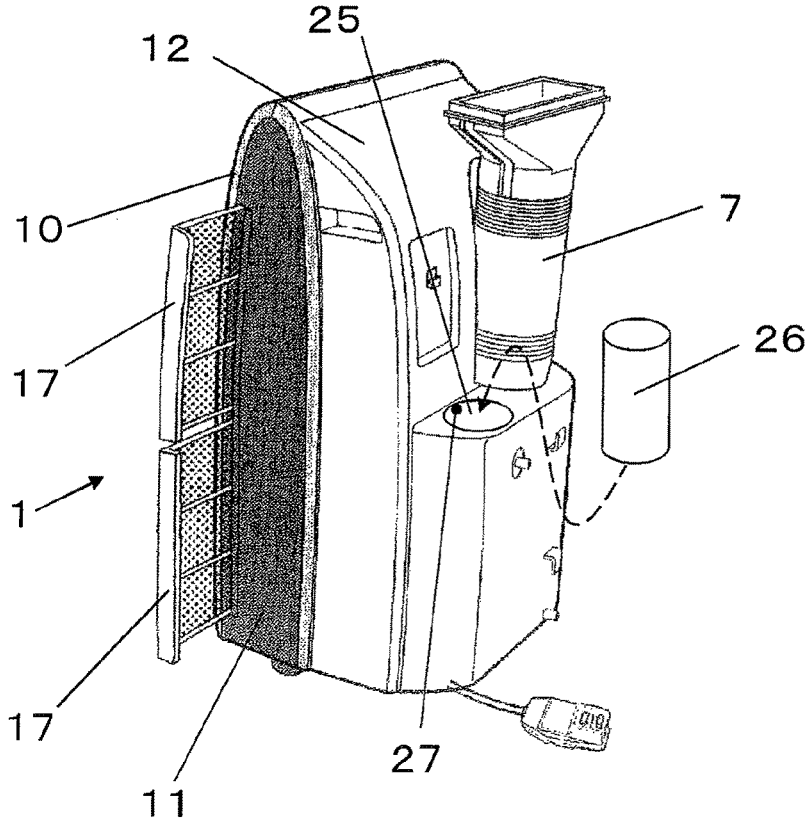
FIG. 2 is another perspective view of the air conditioner.
Figure 3:
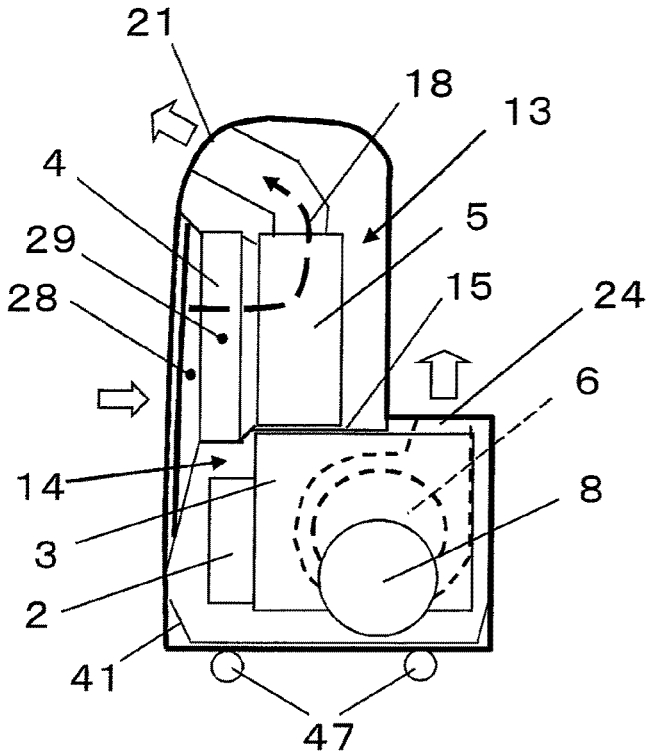
FIG. 3 is a sectional side view of the air conditioner.
Figure 4:
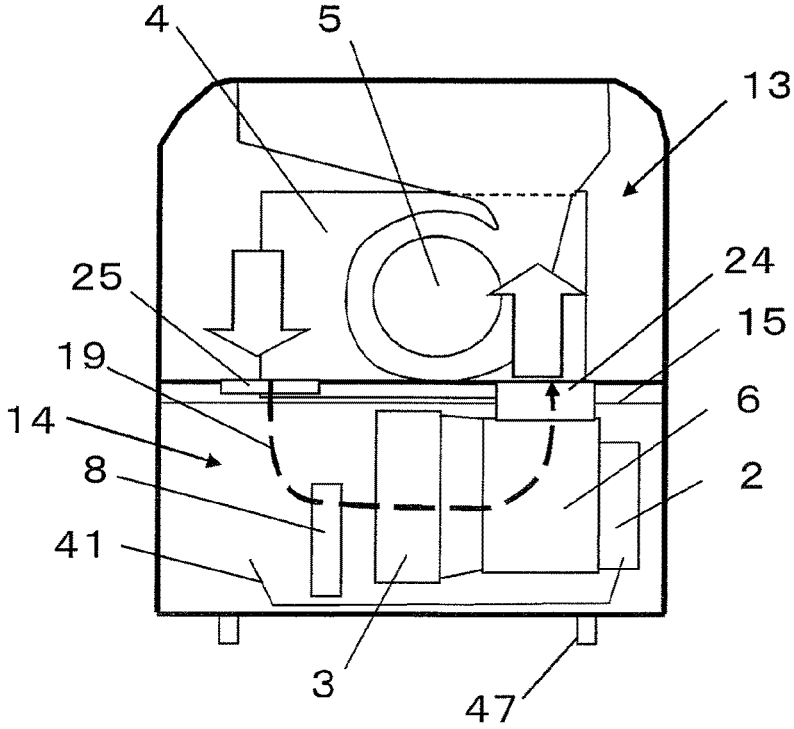
FIG. 4 is a sectional rear view of the air conditioner.

The cabinet 1 has a surrounding structure formed of a front panel 10, a left-right pair of side plates 11 and a back plate 12, as shown in FIGS. 1 and 2. The cabinet 1 is sectioned into an upper cooling chamber 13 and a lower heat release chamber 14. The cooling chamber 13 and the heat release chamber 14 are separated from each other by a partition plate 15.

The evaporator 4 and the blow fan 5 are housed in the cooling chamber 13, while the compressor 2, the condenser 3, the exhaust fan 6 and the splasher 8 are housed in the heat release chamber 14. In the cooling chamber 13, the evaporator 4 is placed at the front side, while the blow fan 5 constituted by a sirocco fan is placed at the back side.

A front suction port 20 and a blowout port 21 are formed in the front panel 10. A side suction port 22 is formed between the front panel 10 and one of the side plates 11. The blowout port 21 is located in an upper portion of the front panel 10 and opens in directions from a horizontal direction to an oblique upward direction. A louver 23 is provided in the blowout port 21. The louver 23 is swung by a motor.

The blowout port 21 communicates with the cooling chamber 13. A vent passage 18 extending from the front suction port 20 and the side suction port 22 to the blowout port 21 via the evaporator 4 is formed, thus realizing suction from the front side of the cabinet 1 and blowout in a forward direction from the cabinet 1. A filter 17 is detachably fitted in the vent passage 18 upstream of the evaporator 4.

The heat release chamber 14 protrudes toward the back side beyond the cooling chamber 13. An air intake port 25 and an exhaust port 24 are formed in left and right positions in an upper surface of the heat release chamber 14. In the heat release chamber 14, a vent passage 19 extending from the air intake port 25 to the exhaust port 24 via the condenser 3 is formed. In the heat release chamber 14, the condenser 3 is disposed across the vent passage 19; the exhaust fan 6 constituted by a sirocco fan and the compressor 2 are disposed downstream of the condenser 3; and the splasher 8 is disposed upstream of the condenser 3. The condenser 3 is placed below the evaporator 4 in such a position that the evaporator 4 and the condenser 3 intersect each other.

A first end of an extendable exhaust duct 7 in bellows form is attached to the exhaust port 24. A second end of the exhaust duct 7 is attached to an opening portion such as a window to enable communication between the heat release chamber 14 and the outside of the room through the exhaust duct 7. One end of an air intake duct 26 is detachably attached to the air intake port 25. The other end of the air intake duct 26 can be attached to an opening portion such as a window, as is the exhaust duct 7.

Thus, supply/expelling of air to or from the heat release chamber 14 can be performed by a double-duct system formed by fitting the first end of the air intake duct 26 to the air intake port 25 and attaching the second end of the air intake duct 26 and the second end of the exhaust duct 7 to an opening portion such as a window. In a case where the second end of the exhaust duct 7 is attached to an opening portion such as a window while the air intake duct 26 is not fitted to the air intake port 25, supply/expelling of air can be performed by a single-duct system.

In the evaporator 4, moisture in the air is condensed to produce drain water when heat exchange on the room air is performed. The drain pan 41 for receiving drain water is provided in the heat release chamber below the evaporator 4, as described above. While the partition plate 15 is provided for partition between the evaporator 4 and the drain pan 41, a water passage (not shown) extending from a position below the evaporator 4 to the drain pan 41 by passing through the partition plate 15 is provided. Drain water flows down through the water passage to be collected in the drain pan 41.

Drain water collected in the drain pan 41 is splashed on the condenser by the splasher 8, which is a water feed device. The splasher 8 is constituted by a fan with a slinger ring, which is rotated to scoop up drain water and sprinkle the drain water on the condenser 3. The splasher 8 is not exclusively used as a water feed device. Drain water may be drawn up with a pump to be sprinkled on an upper portion of the condenser.

A water level sensor (not shown) for detecting the level of water in the drain pan is provided in the drain pan 41. The water level sensor is capable of detecting the level of water at three levels: a low level (Lo), a middle level (Mid) and a high level (Hi).

When drain water passes through the condenser 3, it cools the condenser 3 while evaporating. The condenser 3 is placed above the drain pan 41. Drain water remaining after evaporation on the evaporator flows along the condenser 3 to be again collected in the drain pan 41. Circulation of drain water in the above-described way enables internal drainage without discharging to the outside as well as efficient heat exchange in the condenser 3 utilizing heat of vaporization at the time of evaporation of water. Drain water becomes water vapor to be expelled through the exhaust port 24.

Wheels 47 are mounted on a bottom surface of the cabinet 1 to make the air conditioner movable. The air conditioner can be moved in a room, with the second end of the exhaust duct 7 detached from a window or the like, and with the exhaust duct 7 contracted and maintained integrally with the cabinet 1 in the state of being attached to the exhaust port 24. Further, by detaching the air intake duct 26, the air conditioner is enabled to be carried into a different room and used in a place freely selected.

An air intake duct fitting detection section 27 for detecting the completion of fitting of the air intake duct 26 to the air intake port is provided on the air intake port 25. The air intake duct fitting detection section 27 is constituted by a microswitch which is turned on by fitting the air intake duct 26 to the air intake port 25 to output a fitting detection signal. A device other than the switch may be used as the air intake duct fitting detection section 27 if it is capable of detecting the completion of fitting of the air intake duct 26 to the air intake port 25.

The fitting detection signal from the air intake duct fitting detection section 27 is input to a control section. The control section is constituted by a microcomputer and drives and controls the compressor 2, the blow fan 5, the exhaust fan 6 and the splasher 8. The control section is housed in the cabinet 1 and executes and controls various operations such as a cooling operation, a dehumidifying operation and a ventilating operation according to signals including operation signals from operating switches provided on a remote controller (not shown) or the cabinet and a water level detection signal from the water level sensor. Also, an indicator 50 constituted by light emitting diodes (LEDs) or the like is provided in the front panel 10. The control section performs control, for example, to control lighting of the indicator 50 according to each of the various operations, and to light or blink the indicator 50 for warning about a state where the full drain water level is reached.

In the cooling operation of the air conditioner according to the present embodiment, room air is drawn in through the front suction port 20 and the side suction port 22 by the drive of the blow fan 5 and passes through the filter 17 and then through the evaporator 4. At this time, the drawn air is cooled by the evaporator 4, thereby producing cool air. The cool air is blown out to the interior of the room through the blowout port 21.

On the other hand, air for cooling the condenser 3 is drawn in through the air intake port 25 by the drive of the exhaust fan 6 and heated by the condenser 3, thereby producing hot air. The hot air is expelled out of the cabinet 1 through the exhaust port 24.

In the dehumidifying operation, the compressor 2, the blow fan 5, the exhaust fan 6 and the splasher 8 are driven and controlled, as they are in the cooling operation. With respect to the splasher 8 provided as a water feed device, the control section determines whether or not the exhaust duct 7 is fitted to the exhaust port 24, as described below. The control section operates the splasher 8 when determining that the exhaust duct 7 is fitted to the exhaust port 24, and does not operate the splasher 8 when determining that the exhaust duct 7 is not fitted to the exhaust port 24, thus preventing water vapor produced by evaporation of drain water from being expelled to the interior of the room.

In the ventilating operation, only the exhaust fan 6 is driven, while the compressor 2, the blow fan 5 and the splasher 8 are stopped. Air taken in through the air intake port 25 is expelled from the heat release chamber 14 to the outside of the room via through the exhaust duct 7. At this time, it is necessary that the air intake duct 26 be not fitted to the air intake port 25. As a result, the amount of outside air corresponding to the amount of air expelled from the interior to the outside of the room enters the room, thus performing ventilation of the interior of the room.

In an air blowing operation mode, only the blow fan 5 is driven, while the compressor 2, the exhaust fan 6 and the splasher 8 are stopped, thereby enabling circulation of air in the room.

The splasher 8 provided as a water feed device may be operated at all times during the cooling operation or during the dehumidifying operation in the state where the exhaust duct 7 is fitted to the exhaust port 24. Because the condenser is heated while the compressor is being operated, the water feed device may be operated in synchronization with the compressor to enable evaporation of water with improved efficiency as well as to reduce the time period during which the water feed operation is accompanied by generation of noise.

Figure 5:
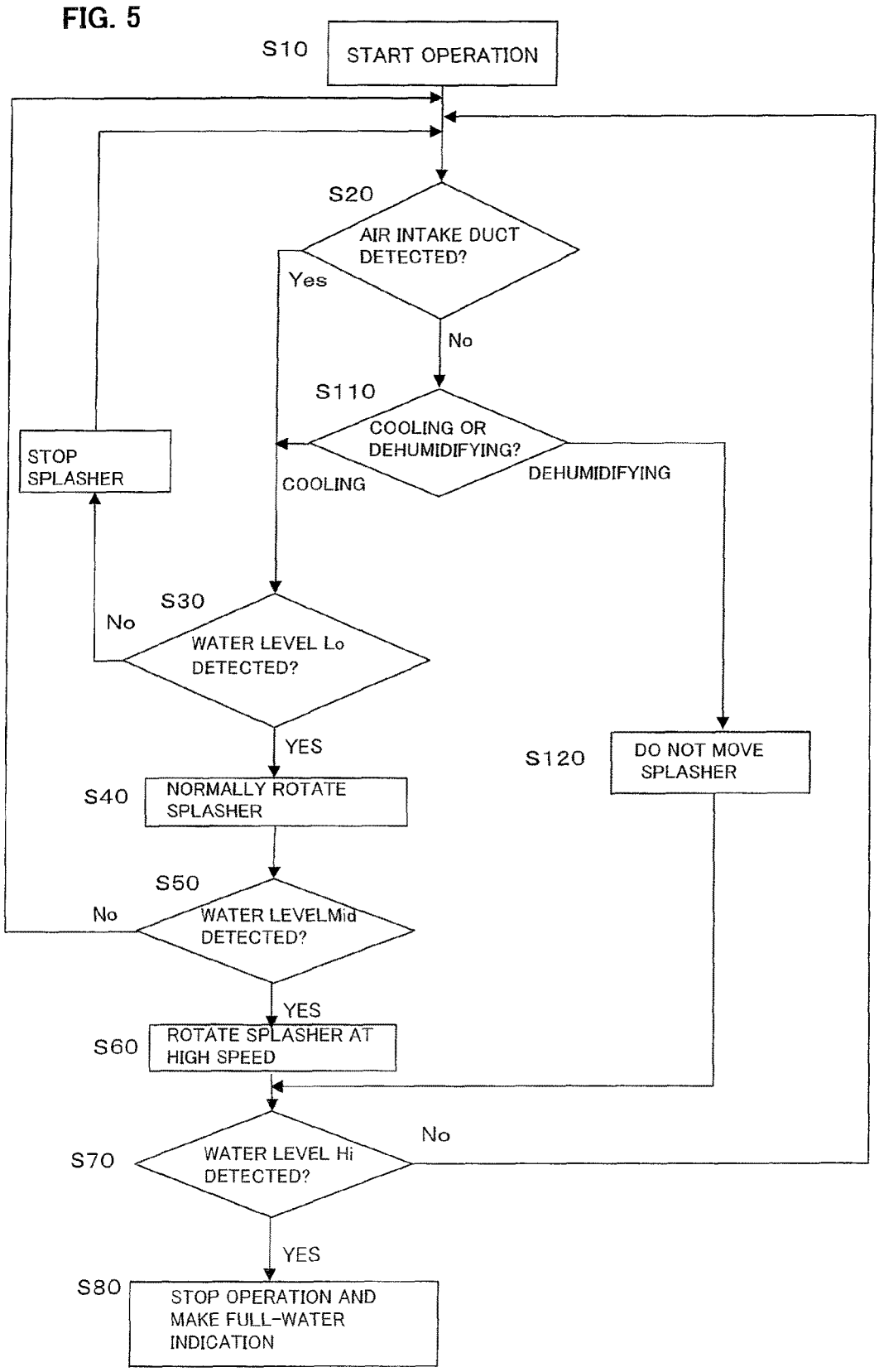
FIG. 5 is a flowchart showing control by a control section in the first embodiment.

The operation control performed by the control section of the integrated air conditioner according to the present embodiment will be described with reference to the flowchart of FIG. 5. First, by operating a remote controller or operating switches, the operation of the air conditioner is started and the cooling operation or the dehumidifying operation is selected as an operating mode (step S10). The control section then determines whether or not the fitting detection signal from the air intake duct fitting detection section 27 has been input (S20).

If the fitting detection signal has been input, the control section determines that the double-duct system is adopted and advances the process to step S30 to measure the water level in the drain pan 41. If the water level measured with the water level sensor is lower than "Lo", the control section determines that no drain water is collected in the drain pan and returns the process to step S20 while maintaining the splasher 8 in the stopped state.

If the water level measured with the water level sensor is equal to or higher than "Lo", the control section operates the splasher 8 at an ordinary rotating speed (S40). If the water level measured with the water level sensor is equal to or higher than "Mid" (S50), the control section operates the splasher 8 at a high rotating speed to increase the amount of evaporation of drain water on the condenser 3. When the water level measured with the water level sensor is equal to or higher than "Lo" and lower than "Mid", the control section operates the splasher 8 at the ordinary rotating speed and, in this state, returns the process to step S20. Thereafter, when the water level in the drain pan 41 becomes lower than "Lo" as a result of reduction of drain water by evaporation, the control section stops the splasher 8 in step S30 and returns the process to step S20.

When the water level measured with the water level sensor is equal to or higher than "Mid" and lower than "Hi", the control section returns the process to step S20 while rotating the splasher 8 at the high rotating speed. When the water level sensor detects that the "Hi" water level is reached, the control section stops the operation of the air conditioner and makes a full-water indication on the indicator 50 to urge the user to discharge drain water.

If, in step S20, the fitting detection signal has not been input to the control section, the control section determines that exhaust heat from the heat release chamber 14 is directly released to the outside of the cabinet through the exhaust port 24 without using the exhaust duct, and advances the process to step S110. If determination is made in this way, it is possible to avoid a fault resulting from an event in which control to be performed in the state where the exhaust duct 7 is fitted is erroneously executed when the exhaust duct 7 is not fitted, which can occur if the detection section for detecting fitting of the exhaust duct 7 is not provided in the present embodiment.

In step S110, the control section determines whether the present operation mode is the cooling operation mode or the dehumidifying operation mode. If the control section determines that the present operation mode is the cooling operation mode, it advances the process to step S30. If the control section determines that the present operation mode is the dehumidifying operation mode, it advances the process to step S70 while maintaining the splasher 8 in the stopped state (S120), and determines whether or not the water level measured with the water level sensor is "Hi". If the water level measured with the water level sensor is lower than "Hi", the control section returns the process to step S20. When the water level reaches "Hi", the control section stops the operation of the air conditioner and makes the full-water indication on the indicator 50.

Figure 6:
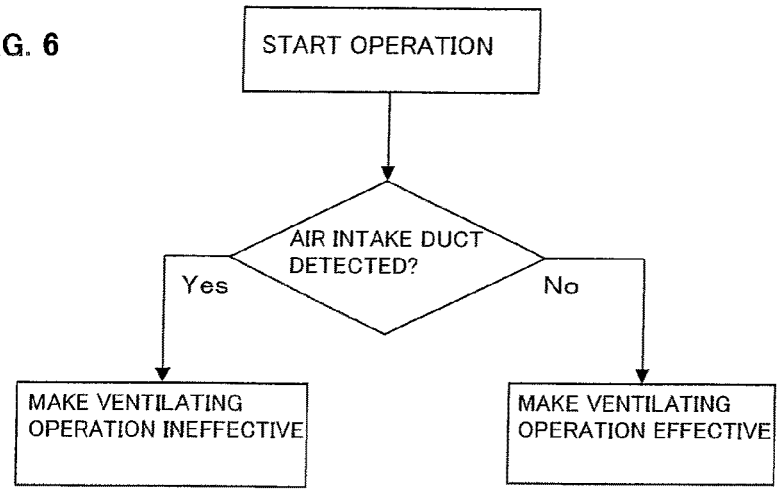
FIG. 6 is a flowchart of control of a ventilating operation in the first embodiment.

If in step S20 the fitting detection signal has been input to the control section, that is, if the control section determines that double-duct system is adopted, the control section limits the selectable operation mode to the cooling operation mode, the dehumidifying operation mode and the air blowing operation mode and makes ineffective an action to change the operation to the ventilating operation when this action is made, as shown in FIG. 6. That is, each of the cooling operation, the dehumidifying operation and the air blowing operation can be performed but the ventilating operation cannot be performed.

On the other hand, if the fitting detection signal has not been input to the control section in step S20, the control section makes effective an action to change the ventilating operation mode, thereby enabling selection of any of the cooling operation mode, the dehumidifying operation mode, the air blowing operation mode and the ventilating operation mode. That is, each of the cooling operation, the dehumidifying operation, the air blowing operation and the ventilating operation can be performed.

As described above, the control section determines whether or not the fitting detection signal from the intake duct fitting detection section 27 has been input and, if the fitting detection signal has been input, determines that the double-duct system is adopted and operates the splasher 8 during the dehumidifying operation as well as during the cooling operation, thus enabling evaporation of drain water at the condenser 3 during the dehumidifying operation as well. Consequently, the frequency of discharge of water collected in the drain pan can be reduced in comparison with the case where the splasher 8 is necessarily stopped when the dehumidifying operation is performed. If the fitting detection signal from the air intake duct fitting detection section 27 has not been input, the operation including collecting drain water in the drain pan without operating the splasher 8 can be performed. Thus, automatic suitable control of the water feed device according to the mode of use of the air conditioner performed by the control section realizes an integrated air conditioner of high convenience.

<Second Embodiment>

Figure 7:
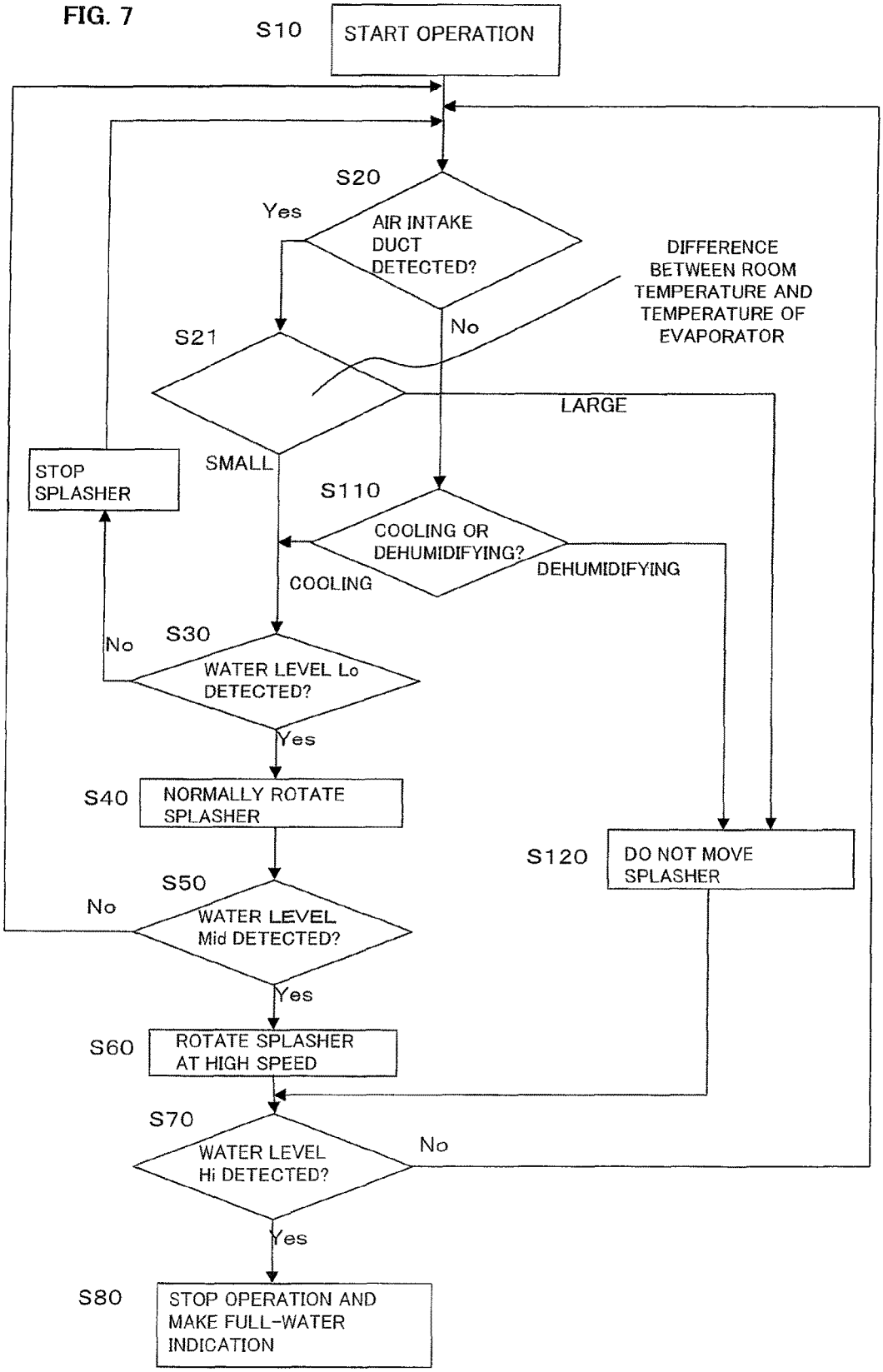
FIG. 7 is a flowchart showing control by a control section in a second embodiment of the present invention.

A second embodiment of the present invention will be described with reference to FIG. 7. A feature of the second embodiment resides in that when supply/expelling of air in the heat release chamber by the double-duct system, the control section detects the difference between the temperature of the evaporator and the indoor temperature measured with temperature sensors and stops the operation of the splasher 8 provided as a water feed device when the temperature difference becomes larger than a predetermined value. In other respects, the structure of the second embodiment is the same as that of the first embodiment.

More specifically, in the vent passage 18 of the cooling chamber 13 of the air conditioner, a temperature sensor 28 for measuring the temperature of air drawn in is provided between the filter 17 and the evaporator 4, and a temperature sensor 29 for measuring the temperature of the surface of the evaporator 4 is also provided. Detection signals from the temperature sensors 28 and 29 are input to the control section.

The control section determines, in step S20, whether or not the fitting detection signal from the air intake duct fitting detection section 27 has been input. If the fitting detection signal has been input, the control section computes, in step S21, the difference between the temperatures obtained from the two temperature sensors 28 and 29 before advancing the process to step S30. If the temperature difference is smaller than the predetermined value, the control section advances the process to step S30. Read of the temperatures with the temperature sensors in step S21 is performed at a time after a lapse of a predetermined time period (after three minutes in the present embodiment) from a start of the operation, at which the refrigerating cycle is stabilized.

When the temperature difference is equal to or larger than the predetermined value (it is desirable to compute, in advance, by making an experiment or a simulation, such a temperature difference that the open-air temperature can be determined as lower than 0° C., and to set the computed temperature difference as the predetermined temperature difference), there is a possibility of the temperature of outside air drawn in through the air intake port 25 being lower than 0° C. and there is a risk of drain water being frozen and, therefore, the operation of the splasher 8 provided as a water feed device is not performed (S120). In other respects, the operation control is the same as that shown in FIG. 6.

<Third Embodiment>

A third embodiment of the present invention will be described with reference to FIGS. 8 and 9. A feature of the third embodiment resides in that the exhaust duct 7 is off the exhaust port 24 in a normal state; the exhaust duct 7 is fitted to the exhaust port 24 as required; and an exhaust duct fitting detection section for detecting the completion of fitting of the exhaust duct 7 to the exhaust port 24 is provided to enable discrimination of the double-duct system and the single-duct system in the control section. In other respects, the structure of the third embodiment is the same as that of the second embodiment.

Figure 8:
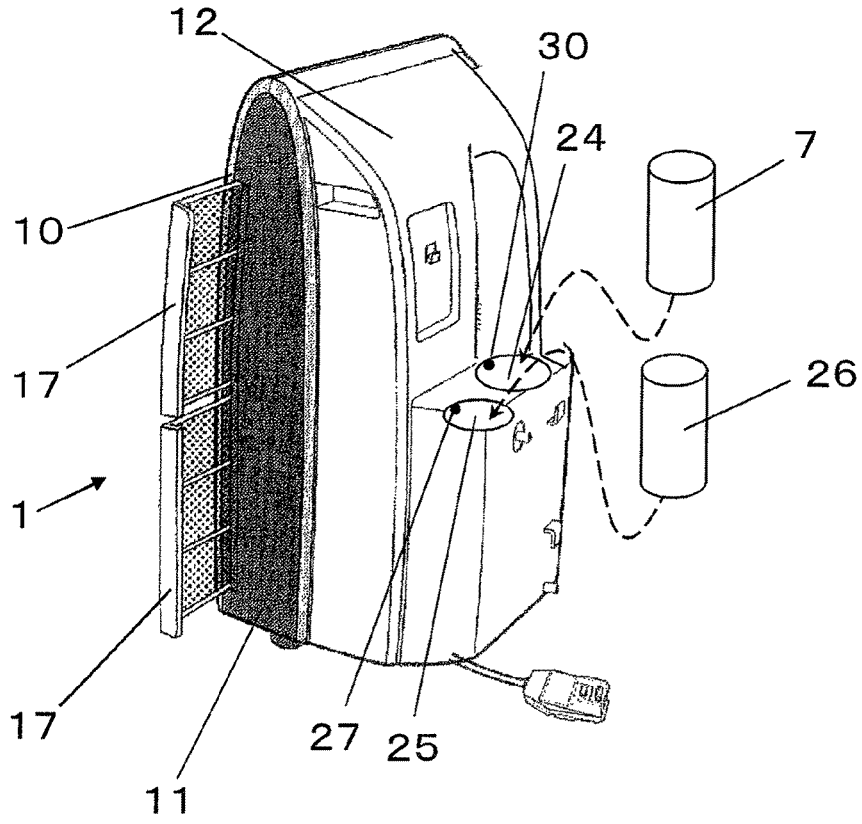
FIG. 8 is a perspective view of an air conditioner according to a third embodiment of the present invention.

More specifically, as shown in FIG. 8, the exhaust duct 7 is off the exhaust port 24, and an exhaust duct fitting detection section 30 for detecting the completion of fitting of the exhaust duct 7 to the exhaust port 24 is provided on the exhaust port 24. The exhaust duct fitting detection section 30 is constituted by a microswitch, which is turned on to output a fitting detection signal when the exhaust duct 7 is fitted to the exhaust port 24. A device other than the switch may be used as the exhaust duct fitting detection section 30 if it is capable of detecting the completion of fitting of the exhaust duct 7 to the exhaust port 24.

Figure 9:
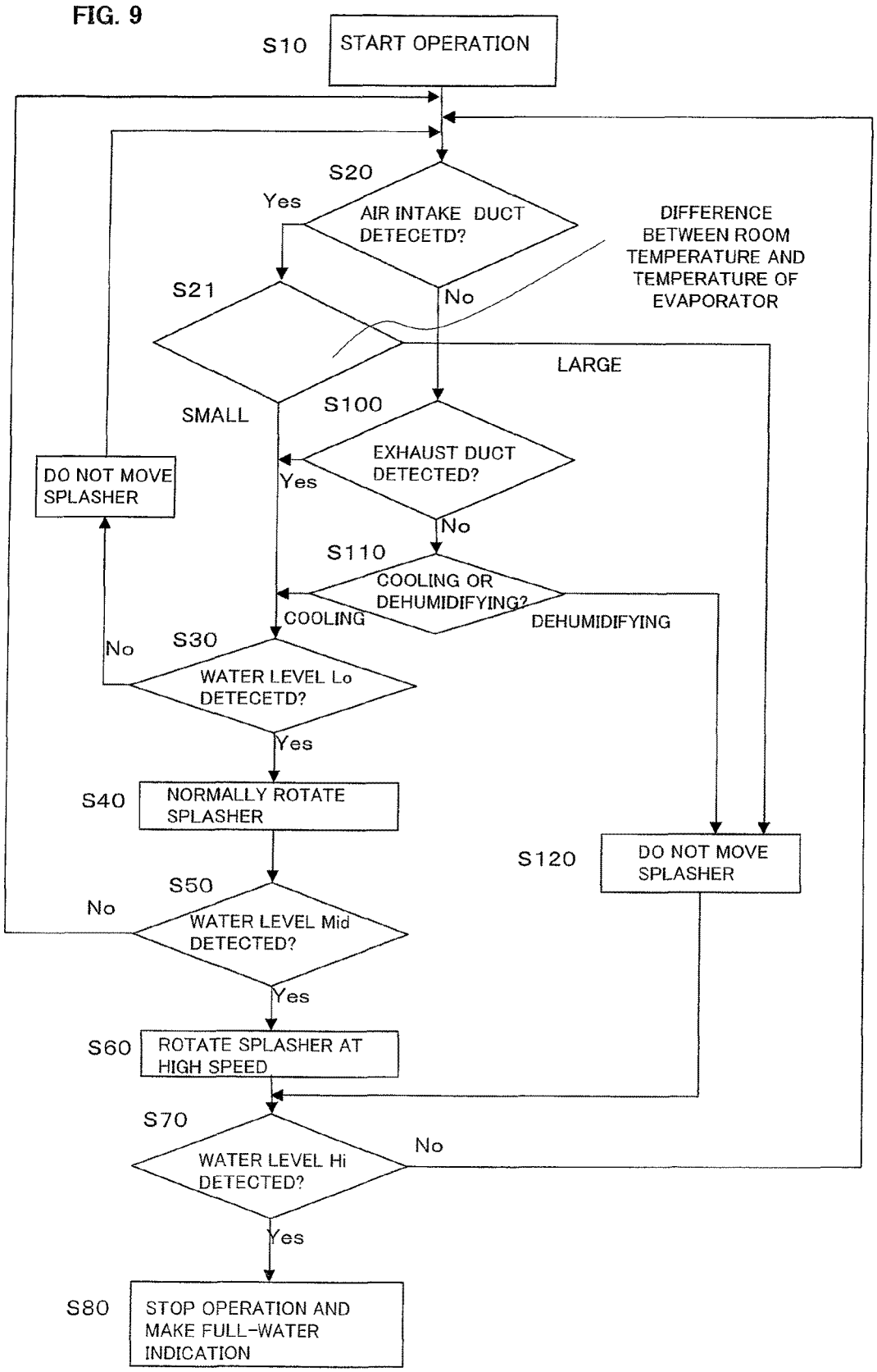
FIG. 9 is a flowchart showing control by a control section in the third embodiment of the present invention.

The control section determines, in step S20, whether or not the fitting detection signal from the air intake duct fitting detection section 27 has been input, as shown in FIG. 9. If the fitting detection signal has not been input, the control section determines, in step S100, before advancement of the process to step S110, whether or not the fitting detection signal from the exhaust duct fitting detection section 30 has been input. If the fitting detection signal has been input, the control section determines that the single-duct system is adopted, and advances the process to step S30 by bypassing step S21. If the fitting detection signal has not been input, the control section determines that the exhaust duct 7 is not fitted to the exhaust port 24, and advances the process to step S110. In other respects, the operation control is the same as that shown in FIG. 7.

In the present embodiment, as described above, the double-duct system and the single-duct system are discriminated from each other and air in a room is drawn in through the air intake port 25 when it is determined that the single-duct system is adopted. Since the possibility of the interior of a room being so cold that drain water is frozen is low, control of the water feed device or restriction on the execution of the ventilating operation mode according the temperature difference between the temperature of the evaporator and the indoor temperature in step 21 is not performed.

The present embodiment has been described with respect to a case where both the exhaust duct fitting detection section 30 and the air intake duct fitting detection section 27 are used. However, the present embodiment is not limited to the described case. Only the exhaust duct fitting detection section 30 may be used.

Figure 10:
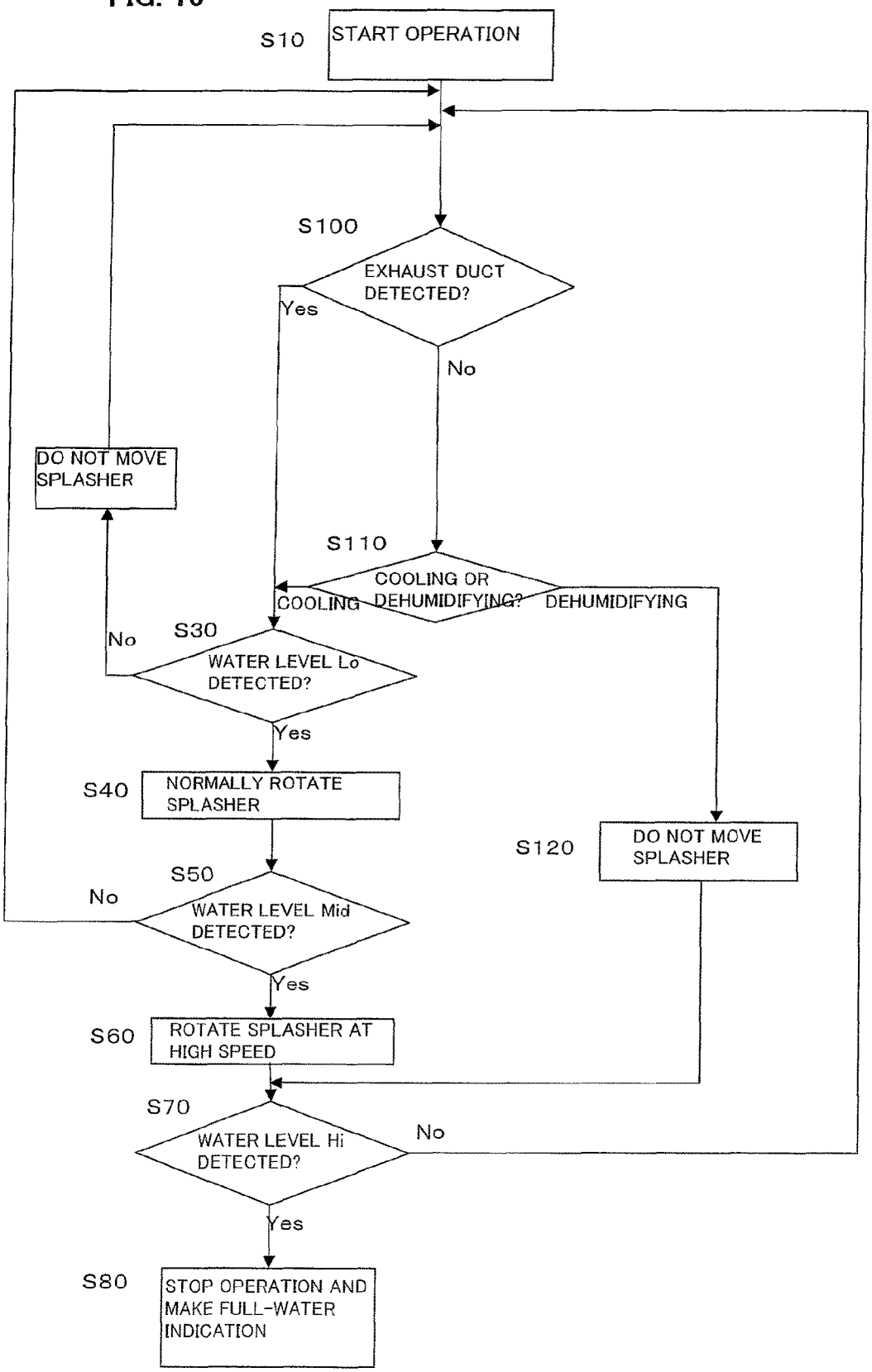
FIG. 10 is a flowchart showing a different mode of control by the control section in the third embodiment.

More specifically, as shown in FIG. 10, step S21 in FIG. 9 is removed and a determination as to whether or not the fitting detection signal from the exhaust duct fitting detection section 30 has been input is made in step S100 in place of step S20 after the execution of step S10. If the fitting detection signal has been input, the control section determines that the single-duct system or the double-duct system is adopted and advances the process to step S30. If the fitting detection signal has not been input, the control section determines that exhaust duct 7 is not fitted to the exhaust port 24 and advances the process to step S110. In other respects, the operation control is the same as that shown in FIG. 9. Thus, while a simpler structure not using the air intake duct fitting detection section 27 is adopted, it is possible to reliably make a determination as to whether or not the exhaust duct 7 is used.

The present invention is not limited to the above-described embodiments. Needless to say, various modifications and changes can be made in the above-described embodiments within the scope of the present invention.

What is claimed is:

1. An integrated air conditioner having a compressor, an evaporator, a condenser, a drain pan in which drain water produced by the evaporator is collected, and a water feed device which leads drain water collected in the drain pan to the condenser; the compressor, the evaporator and the condenser being housed in a cabinet, the integrated air conditioner comprising:

a control section for controlling the operation of the water feed device;

an air intake port and an exhaust port for drawing in and expelling of air for cooling the condenser, the air intake port and the exhaust port being formed in the cabinet; and an air intake duct and an exhaust duct which can be respectively fitted to the air intake port and the exhaust port, wherein the control section is configured to:

determine whether or not exhaust heat from the condenser is being released outdoors through the exhaust duct according to whether or not the air intake duct or the exhaust duct is fitted, operate the water feed device for an entire room to be cooled or dehumidified during both of a cooling operation and a dehumidifying operation if the control section determines that the exhaust heat from the condenser is being released outdoors, and stop the operation of the water feed device during the dehumidifying operation if the control section determines that the exhaust heat from the condenser is not being released outdoors and operates the water feed device for the room to be cooled partially during the cooling operation.

2. The integrated air conditioner according to claim 1, further comprising an air intake duct fitting detection section which detects the completion of fitting of the air intake duct to the air intake port, wherein the control section is configured to determine that exhaust heat from the condenser is being released outdoors through the exhaust duct when a fitting detection signal from the air intake duct fitting detection section is input, and determine that exhaust heat from the condenser is not being released outdoors through the exhaust duct when the fitting detection signal from the air intake duct fitting detection section is not input.

3. The integrated air conditioner according to claim 2, further comprising temperature sensors for respectively measuring the temperature of the evaporator and the indoor temperature, wherein the control section is configured to not operate the water feed device when the fitting detection signal from the air intake duct fitting detection section is input if the control section determines that the difference between the temperatures detected with the two temperature sensors is larger than a predetermined value.

4. The integrated air conditioner according to claim 2, wherein the control section can selectively execute one of a ventilating operation mode in which only an exhaust fan which draws in air through the air intake port and expels the drawn air through the exhaust port is operated in a state where the operation of the compressor is stopped and an air blowing operation mode in which only an indoor fan is operated as well as a cooling operation mode and a dehumidifying operation mode, and the control section restricts the execution of the ventilating operation mode and makes executable one of the cooling operation mode, the dehumidifying operation mode and the air blowing operation mode when the fitting detection signal from the air intake duct fitting detection section is being input.

5. The integrated air conditioner according to claim 1, further comprising an exhaust duct fitting detection section which detects the completion of fitting of the exhaust duct to the exhaust port, wherein the control section is configured to determine that exhaust heat from the condenser is being released outdoors through the exhaust duct when a fitting detection signal from the exhaust duct fitting detection section is input, and determine that exhaust heat from the condenser is not being released outdoors through the exhaust duct when the fitting detection signal from the exhaust duct fitting detection section is not input.

6. The integrated air conditioner according to claim 2, further comprising an exhaust duct fitting detection section which detects the completion of fitting of the exhaust duct to the exhaust port, wherein the control section is configured to determine that exhaust heat from the condenser is being released outdoors through the exhaust duct when the fitting detection signal from the air intake duct fitting detection section is input, check whether or not the fitting detection signal from the exhaust duct fitting detection section is input when the fitting detection signal from the air intake duct fitting detection section is not input, determine that exhaust heat from the condenser is being released outdoors through the exhaust duct when a fitting detection signal from the exhaust duct fitting detection section is input, and determine that exhaust heat from the condenser is not being released outdoors through the exhaust duct when the fitting detection signal from the exhaust duct fitting detection section is not input.

* * * * *